US006959842B2

(12) United States Patent
Vert

(10) Patent No.: US 6,959,842 B2
(45) Date of Patent: Nov. 1, 2005

(54) FLUID-DISPENSING DEVICE PROVIDED WITH LOCKING MEANS

(75) Inventor: Gilles Vert, Aurillac (FR)

(73) Assignee: Qualipac, Neuilly-sur-Seine (FR)

( * ) Notice: Subject to any disclaimer, the term of this patent is extended or adjusted under 35 U.S.C. 154(b) by 281 days.

(21) Appl. No.: 10/608,007

(22) Filed: Jun. 30, 2003

(65) Prior Publication Data

US 2004/0011818 A1 Jan. 22, 2004

(30) Foreign Application Priority Data

Jul. 17, 2002 (FR) ..... 02 09036

(51) Int. Cl.[7] ..... B67D 5/33

(52) U.S. Cl. ..... 222/153.13; 222/321.7; 222/321.9

(58) Field of Search ..... 222/153.13, 153.14, 222/321.1, 321.7, 321.9

(56) References Cited

U.S. PATENT DOCUMENTS 3,738,537 A 6/1973 Gach
4,944,429 A 7/1990 Bishop et al.
5,255,823 A * 10/1993 Tichy et al. ..... 222/153.14
5,492,251 A * 2/1996 Albini et al. ..... 222/153.13
5,875,932 A * 3/1999 Meshberg ..... 222/153.13
6,196,423 B1 * 3/2001 Erxleben ..... 222/321.7
6,247,613 B1 * 6/2001 Meshberg ..... 222/321.9

FOREIGN PATENT DOCUMENTS

FR 2 113 872 6/1972

* cited by examiner

*Primary Examiner*—Kenneth Bomberg
(74) *Attorney, Agent, or Firm*—Young & Thompson

(57) ABSTRACT

Device for dispensing fluid, comprising a body, a push-button and locking means. The body is intended to be fixed to the neck of a bottle. The push-button can be depressed in relation to the body in an activating direction between a rest position and a depressed position in order to control fluid-dispensing means. The locking means have an active state in which they prevent the push-button from being depressed in the activating direction and an inactive state in which they allow the pressing action. In order to move the locking means from the inactive state to the active state thereof, a force must be applied to the push-button in the activating direction in order to displace the push-button, from the rest position to a locked position, by translation in relation to the body in the opposite sense to that in which it is pressed in.

5 Claims, 4 Drawing Sheets

FLUID-DISPENSING DEVICE PROVIDED WITH LOCKING MEANS

BACKGROUND OF THE INVENTION

1. Field of the Invention

The invention relates to a device for dispensing fluid and, in particular, cosmetic fluid.

It more particularly relates to fluid-dispensing devices of the type having a push-button which controls means for dispensing fluid. Its purpose is to prevent any inadvertent activation of the push-button which could, in particular, lead to the contents of the bottle being spilled in toilet bags.

2. Description of the Prior Art

EP-A-0 659 157 describes a device comprising:

a body which is intended to be fixed to the neck of a bottle, a push-button which can be depressed in relation to the body in an activating direction between a rest position and a depressed position in order to control fluid-dispensing means, locking means having an active state in which they prevent the push-button from being depressed in the activating direction and an inactive state in which they allow the pressing action.

However, since the locking means are constituted by a ring which is mounted so as to rotate about the body in the activating direction in order to prevent the push-button from being depressed by translation in the same direction, it is necessary to provide a supplementary piece (the ring), which is separate from the push-button and the body. Moreover, this supplementary piece must be visible so that it can be readily activated by the user.

SUMMARY OF THE INVENTION

The purpose of the invention is to reduce the excessive cost resulting from the locking means proposed in EP-A-0 659 157 for producing the dispensing device and to overcome the aesthetic disadvantage caused by the presence of this ring.

To this end, the invention proposes that, in order to move the locking means from the inactive state to the active state thereof, a force must be applied to the push-button in the activating direction in order to displace the push-button, from the rest position to a locked position, by translation in relation to the body in the opposite sense to that in which it is pressed in.

Since the locking is controlled by the displacement of the push-button in relation to the body according to a translation in the same direction (but in the opposite sense) as the pressing of the push-button, it is not necessary to provide a separate piece to effect the locking and the construction of the body and the push-button requires very little modification.

Consequently, the construction and the assembly of the device are simplified, thereby reducing the cost price thereof.

Moreover, the user has only two pieces (the push-button and the body) to be displaced in relation to each other and in only one direction. The use of the device is therefore simplified and the number of visible pieces is reduced.

A simple solution proposed by the invention consists in the locking means comprising a projection and a small bar, one of which is connected to the body and the other of which is connected to the push-button, the small bar and/or the projection being deformed in a resilient manner when the locking means move from the active position to the inactive position and vice-versa.

These means are relatively inexpensive and allow the user to perceive a notch which he can pass by applying a force when it is desirable to move the locking means from the active position to the inactive position.

In order further to ensure reliability and prevent spillage of the fluid, even if this force is inadvertently applied to the button, the invention proposes that:

an aperture is provided between the body and the push-button when the push-button is in the locked position, this aperture being substantially reduced when the push-button is not in the locked position, the locking means comprise at least one resiliently deformable lug which forms a stop when the push-button is in the locked position by being introduced between the body and the push-button, when the push-button is not in the locked position, the lug is tensioned so that the lug is automatically introduced into the aperture, by resilient return, when the push-button is moved into the locked position.

In this manner, automatic locking is obtained by blocking of the push-button and the push-button can be unlocked only by means of action on the lug.

In order further to reduce the cost of the device, the resiliently deformable lug is preferably constructed as one piece with the body.

Moreover, to improve the strength of the device, the locking means advantageously comprise two resiliently deformable lugs.

BRIEF DESCRIPTION OF THE DRAWINGS

The invention will be appreciated even more clearly from the following description given with reference to the appended drawings, in which.

DESCRIPTION OF THE PREFERRED EMBODIMENT

Figure 1:
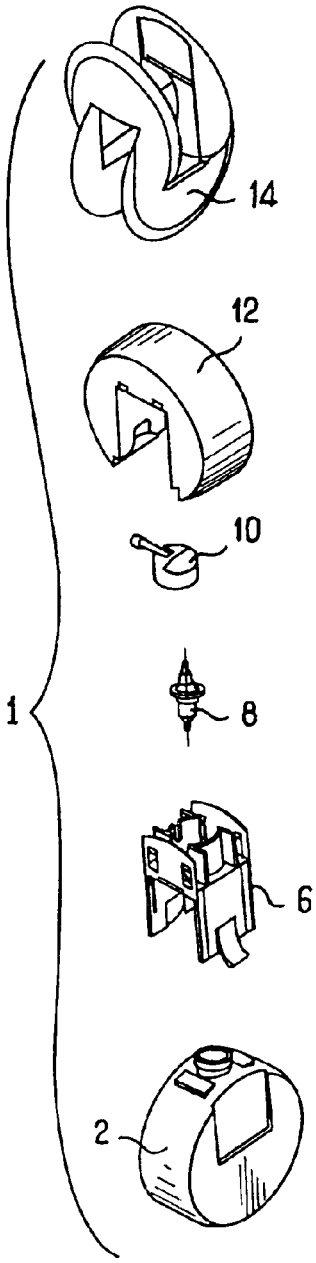
FIG. 1 is an exploded perspective view of the assembly.

The Figures illustrate an assembly 1 comprising a bottle 2 which is provided with a device 4 for dispensing fluid, in particular cosmetic fluid.

The dispensing device 4 is fixed to the neck of the bottle 2 and substantially comprises a body 7, a pump 8 which forms fluid-dispensing means, a dispensing head 10 which is provided with a flexible rod 11, a push-button 12 (constituted here by two portions 12*a*, 12*b*) and locking means 20. The body 7 comprises a shell 14 and an internal element 6 which are held together by means of snap-fitting devices 32.

Figure 4:
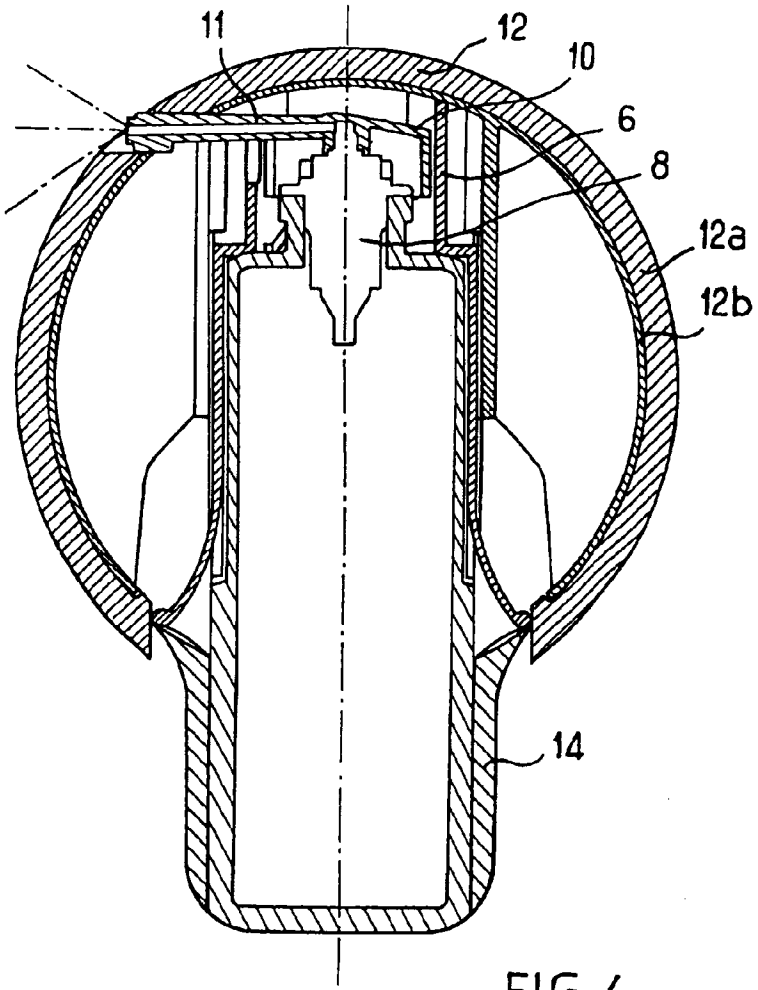
FIG. 4 is a view of the dispensing device according to FIG. 2, with the push-button in the depressed position.

In conventional manner, in order to obtain some of the product, the user presses on the push-button 12 in an activating direction 16 starting from the released, rest position. The push-button 12 is then depressed into the shell 14 and displaces the dispensing head 10 in the activating direction 16, as illustrated in FIG. 4. Owing to the displacement of the dispensing head 10, the pump 8 is activated, thus supplying the cosmetic product.

Figure 2:
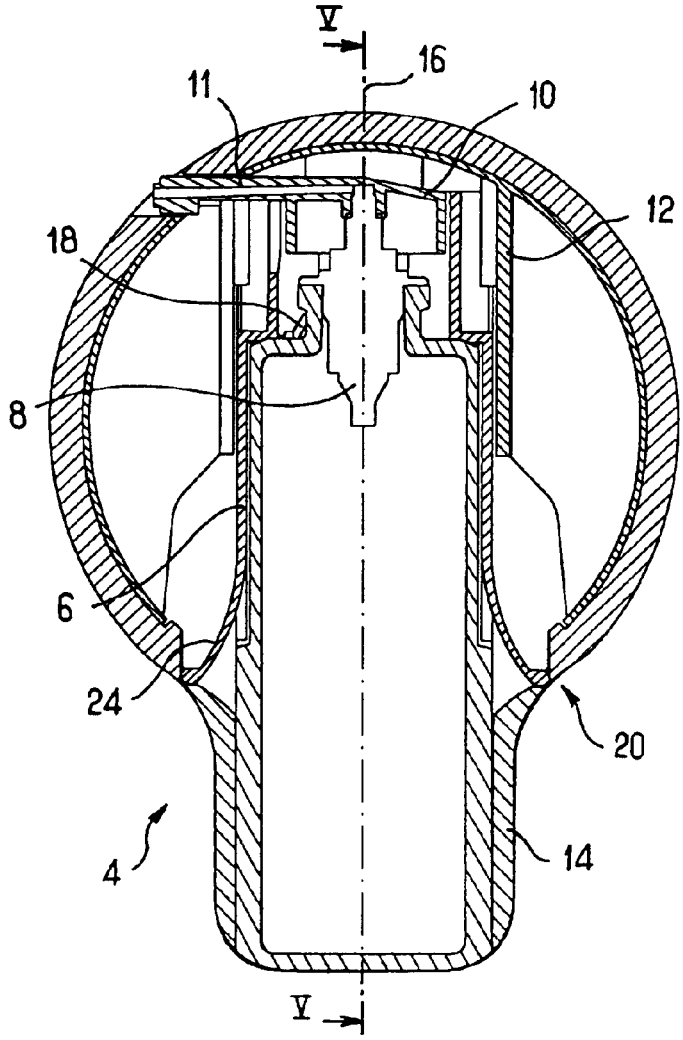
FIG. 2 is a central sectional view of the dispensing device, along line II—II of FIG. 5, with the push-button in the rest position.
Figure 5:
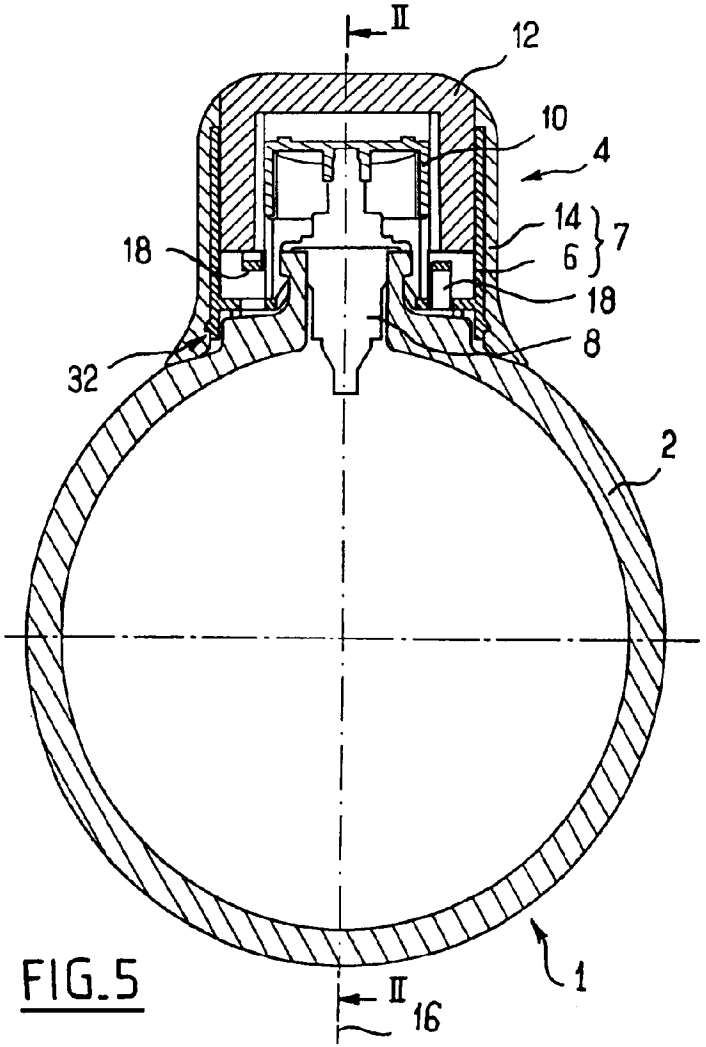
FIG. 5 is a sectional view along line V—V of FIG. 2.
Figure 7:
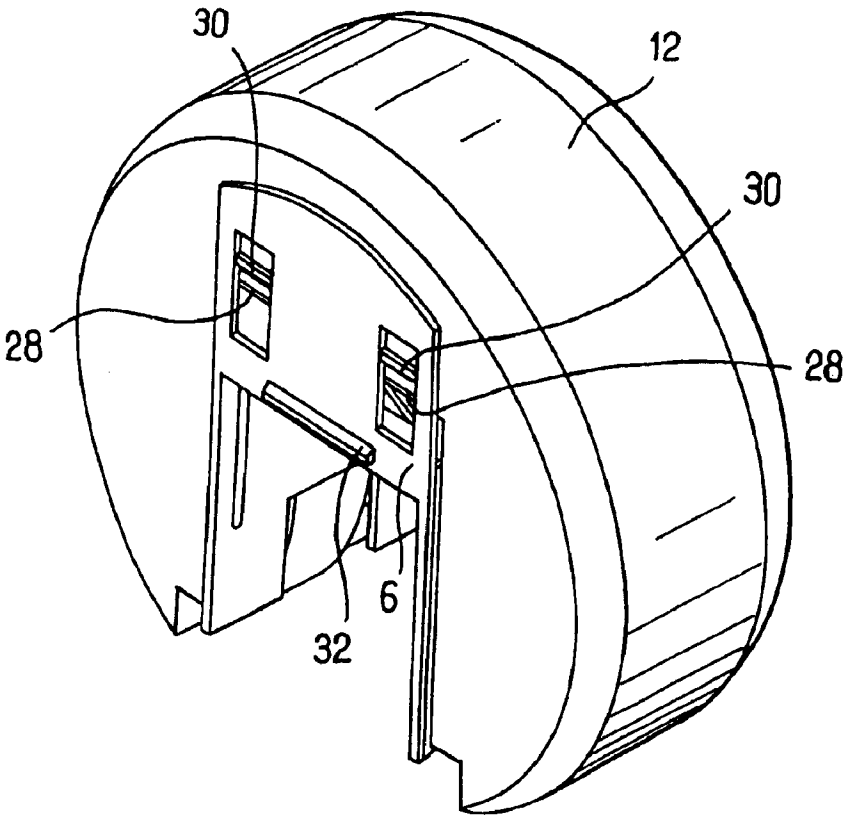
FIG. 7 is a perspective view of the internal element and the push-button only, the push-button being in the unlocked position.
Figure 8:
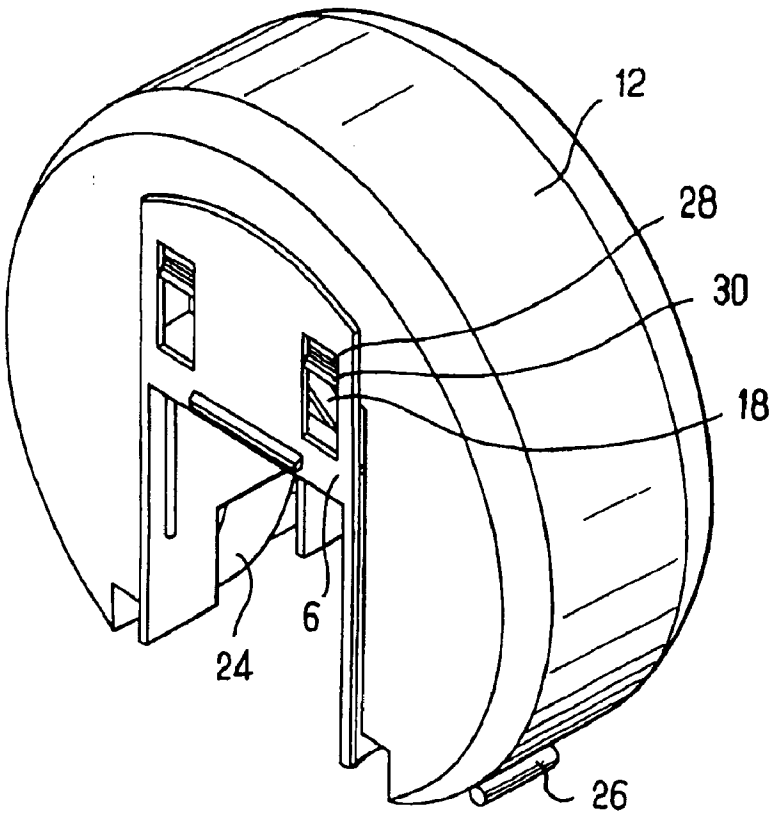
FIG. 8 is a view according to FIG. 7, the push-button being in the depressed position.

When the user releases the pressure on the push-button 12, the push-button 12 and the dispensing head 10 are returned, under the action of two spring plates 18, to the rest position illustrated in FIGS. 2, 5 and 7.

The locking means 20 are intended to prevent inadvertent spillage of cosmetic product. They comprise two resilient lugs 24, which are constructed as one piece with the internal element 6, and have an active state which corresponds to the locked position of the push-button and an inactive state which corresponds to the other positions of the push-button. In order to activate the locking means, starting from the rest position of the push-button, the user pulls on the push-button 12, that is to say, the user acts on the push-button to displace it in the activating direction 16 in the opposite sense to that causing the product to be dispensed.

Two spaces, each of which defines an aperture 22, are then created between the shell 14 and the push-button 12, into which spaces resilient lugs 24, which were pretensioned, are introduced. Since the apertures 22 are then blocked by the free ends 26 of the resilient lugs 24, it is not possible to close the apertures once more simply by displacing the push-button in relation to the shell in the opposite sense, that is to say, only by pressing on the push-button 12. The push-button 12 is then in the locked position illustrated in FIG. 3.

Figure 3:
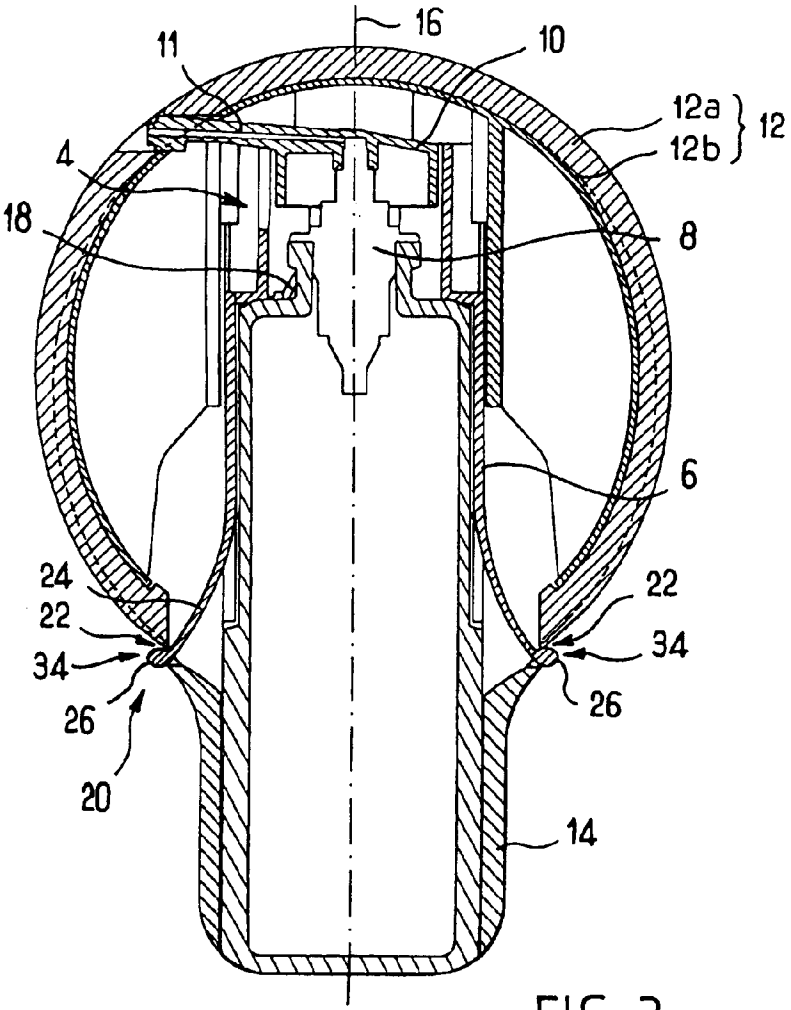
FIG. 3 is a view of the dispensing device according to FIG. 2, with the push-button in the locked position.
Figure 6:
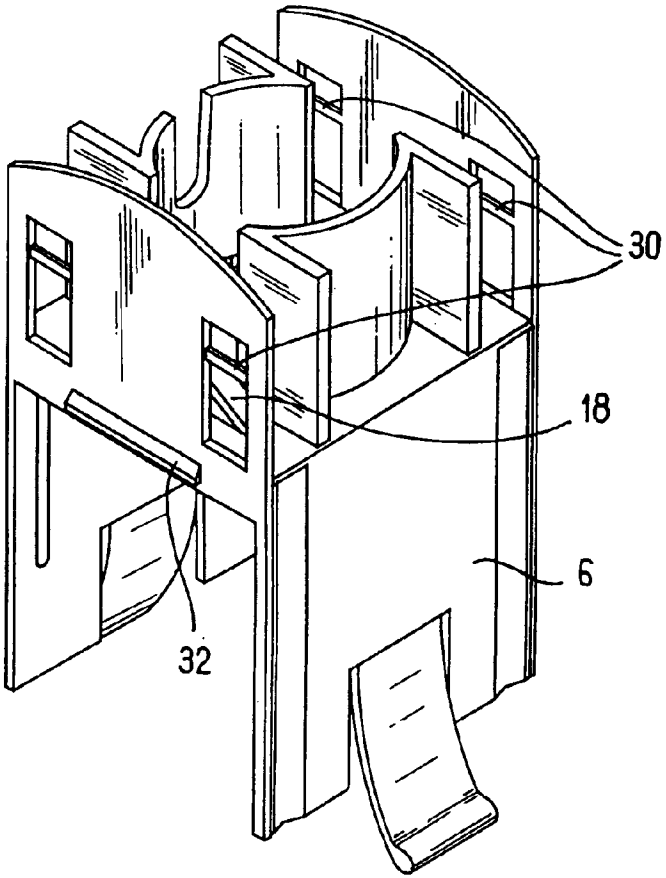
FIG. 6 is a perspective view of the body.

In order to unlock the push-button 12, the ends 26 of the resilient lugs 24 must be pushed, as indicated by the arrows designated 34 in FIG. 3, in order to free the apertures 22 and simultaneously to press on the push-button 12.

In order to prevent the dispensing device 10 from inadvertently switching to the locked position, the push-button is provided with four projections 28, each of which comes into contact with a small resilient bar 30 which belongs to the internal element 6 and which extends transversely to the activating direction 16. In this manner, in order to place the dispensing device 10 in a locked position starting from the rest position, or vice-versa, it is necessary to overcome the resilient resistance of the small resilient bars 30 which results from the resilient deformation thereof when the projections 28 are passed.

The invention further has the advantage that the locking of the assembly 1 in a non-dispensing position is obtained without any pieces being added since the resilient lugs 24 are integrated in the internal element 6.

I claim:

1. Device for dispensing fluid, comprising:

a body which is intended to be fixed to the neck of a bottle, a push-button which can be depressed in relation to the body in an activating direction between a rest position and a depressed position in order to control fluid-dispensing means, locking means having an active state in which they prevent the push-button from being depressed in the activating direction and an inactive state in which they allow the pressing action, wherein, in order to move the locking means from the inactive state to the active state thereof, a force must be applied to the push-button in the activating direction in order to displace the push-button, from the rest position to a locked position, by translation in relation to the body in the opposite sense to that in which it is pressed in.

2. Device according to claim 1, wherein the locking means comprise a projection and a small bar, one of which is connected to the body and the other of which is connected to the push-button, the small bar and/or the projection being deformed in a resilient manner when the locking means move from the active position to the inactive position and vice-versa.

3. Device according to either claim 1, wherein:

an aperture is provided between the body and the push-button when the push-button is in the locked position, this aperture being substantially reduced when the push-button is not in the locked position, the locking means comprise at least one resiliently deformable lug which forms a stop when the push-button is in the locked position by being introduced between the body and the push-button, when the push-button is not in the locked position, the lug is tensioned so that the lug is automatically introduced into the aperture, by resilient return, when the push-button is moved into the locked position.

4. Device according to claim 3, characterised in that the resiliently deformable lug is constructed as one piece with the body.

5. Device according to claim 3, wherein the locking means comprise two resiliently deformable lugs.

* * * * *